United States Patent [19]

Hu

[11] Patent Number: 4,844,368

[45] Date of Patent: Jul. 4, 1989

[54] TOILET PAPER CASE

[76] Inventor: Dye-Chung Hu, No. 172, Hsin-Hsing Rd., Pei-Tun Dist., Taichung, Taiwan

[21] Appl. No.: 264,907

[22] Filed: Oct. 31, 1988

[51] Int. Cl.[4] ..... B65H 19/00; B65H 35/06

[52] U.S. Cl. ..... 242/55.53; 225/43; 225/46; 225/77

[58] Field of Search ..... 242/55.2, 55.53; 225/39, 43, 46, 47, 49, 51, 77, 91, 106

[56] References Cited

U.S. PATENT DOCUMENTS

| | | | |
|---|---|---|---|
| 2,132,177 | 10/1938 | Mezoff | 225/43 |
| 2,271,135 | 1/1942 | Crebbs | 225/43 |
| 2,322,456 | 6/1943 | Krueger | 242/55.53 |
| 2,695,208 | 11/1954 | Graham | 225/46 |
| 3,516,615 | 6/1970 | Wickenberg | 242/55.2 |

*Primary Examiner*—David Werner

*Attorney, Agent, or Firm*—Jeffers, Hoffman & Niewyk

[57] ABSTRACT

A toilet paper case comprises a U-shaped housing, a curved cover plate hinged to the housing and a shaft for carrying a reel of toilet paper. The curved cover plate is provided with a forked end which has an inner toothed edge and an outer toothed edge. The inner toothed edge may be an edge with a series of sharp teeth, needles, or bumps or a rough edge face to engage with the paper so as to limit the unreeling of the paper, and the outer toothed edge includes sharp teeth to cut the paper. The cover plate is normally biased to an open position and a tongue-and-hole engagement means is provided to lock the cover plate in a closed position.

4 Claims, 3 Drawing Sheets

TOILET PAPER CASE

BACKGROUND OF THE INVENTION

This invention relates to a toilet paper case, and particularly to a toilet paper case which can be mounted on a wall and includes a toothed cutting edge to cut the toilet paper from a reel which is provided in the case.

A conventional toilet paper case includes a housing which can be mounted on a wall and which carries a reel of toilet paper, and a hinged cover which has one end thereof toothed so as to cut the toilet paper. Such a toilet paper case has the following disadvantages: (1) when one desires to take a piece of paper from the paper reel, he must use one hand to depress the cover plate and another hand to cut the paper; (2) in many cases, the paper can not be cut off properly since the paper cannot be prevented from unreeling; and (3) sometimes, the cover plate with the toothed edge, when lifted for the replacement of a paper reel, may turn down and hurt the hand of the user.

SUMMARY OF THE INVENTION

An object of the invention is to provide a toilet paper case with a cover plate which has two toothed edges, one for limiting the unreeling of the paper and the other for cutting the paper, thereby enabling the toilet paper to be cut off neatly and properly.

Another object of the invention is to provide a toilet paper case with a cover plate which can be locked in a closed position so that the paper can be cut off with the use of only one hand.

Still another object of the invention is to provide a toilet paper case with a cover plate which can be retained in an open position when replacing the paper reel.

According to the present invention, a toilet paper case comprises a U-shaped housing, a curved cover plate covering the top and front open side of the housing, the curved cover plate having a rear end hinged to the housing at the top side and extending forward and then downward, the front end of the cover plate being forked in order to provide an inner toothed edge and an outer toothed edge, the inner toothed edge engaging the paper so as to limit the unreeling of the paper and the outer toothed edge cutting the paper, and a shaft for carrying a reel of paper.

In one aspect of the present invention, a torsion spring is attached to the hinge member which hinges the cover plate so as to bias the cover plate to retain an open position, and a tongue-and-hole engagement means provided on the housing and the cover plate so as to prevent the cover plate from being moved to the open position.

In another aspect of the invention, the outer toothed edge includes sharp teeth and the inner toothed edge may be an edge with a series of sharp teeth, needles or bumps or a rough edge face which can limit the unreeling of the paper.

In still another aspect of the invention, the tongue-and-hole engagement means includes holes which are provided in the side segments adjacent to the front side of the housing, wherein the cover plate has two lugs extending from two opposite sides of the cover plate and substantially normal to the cover plate, the lugs abutting with the side segments when the cover plate is closed. The tongue-and-hole engagement means further includes two tongues respectively projecting from the lugs to engage with the holes.

The present exemplary preferred embodiment will be described in detail with reference to the accompanying drawings, in which:

DETAILED DESCRIPTION OF THE PREFERRED EMBODIMENT

Figure 1:
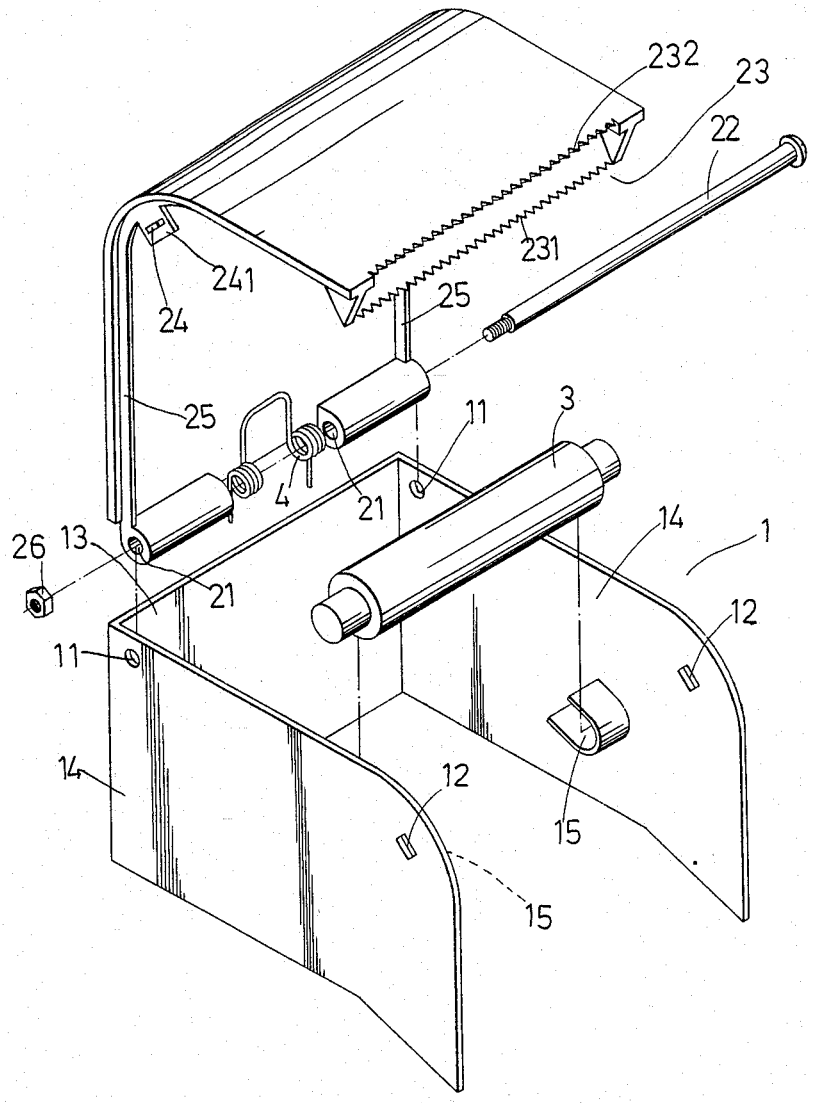
FIG. 1 is an exploded view of a toilet paper case of the present invention.
Figure 2:
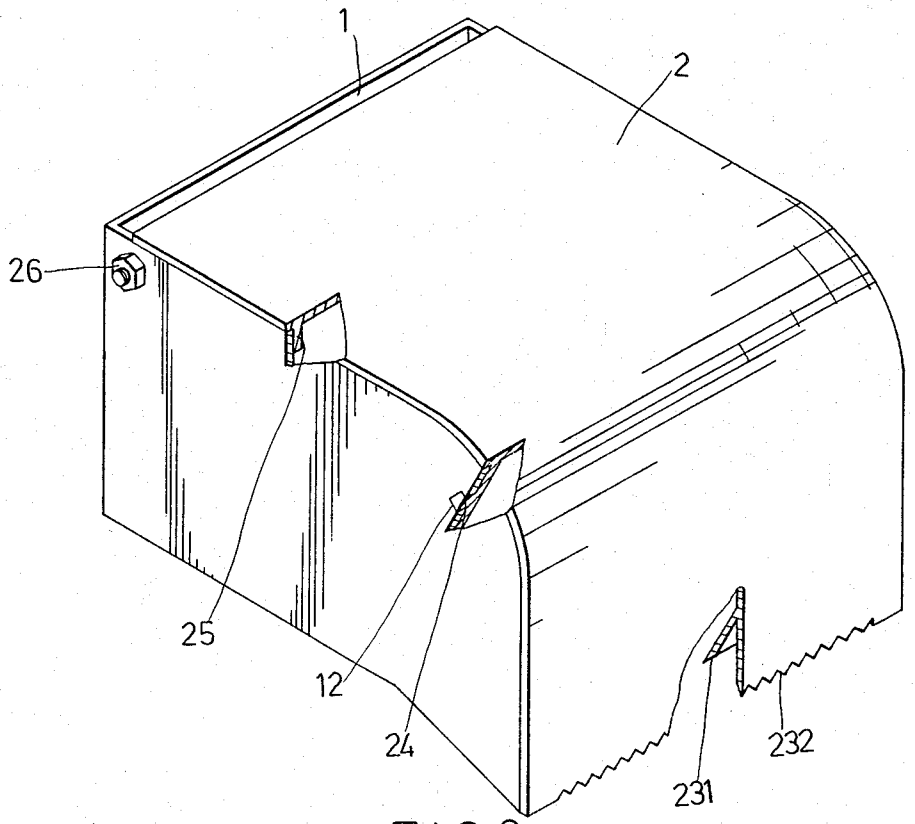
FIG. 2 is a perspective view of the toilet paper case of FIG. 1.
Figure 3:
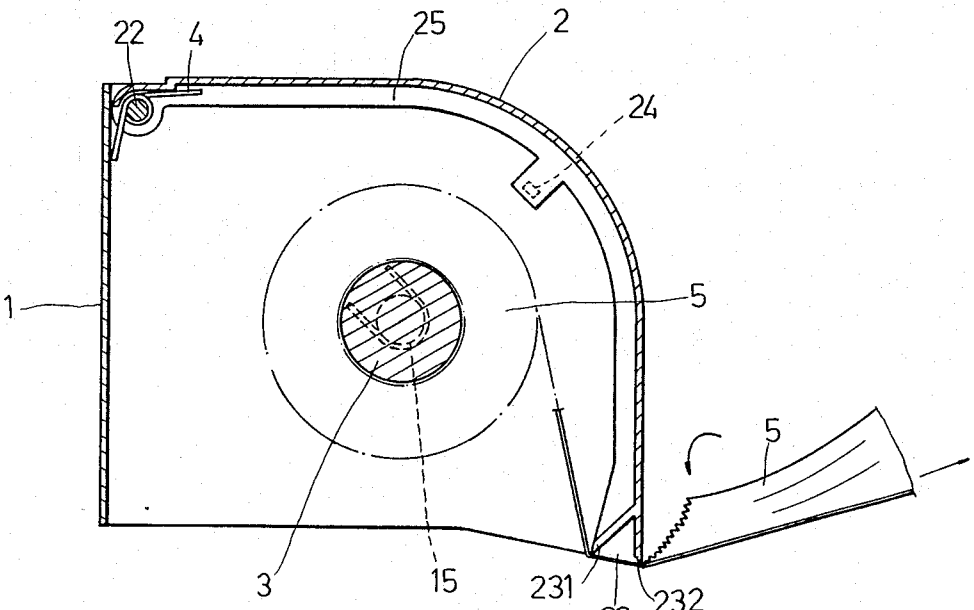
FIG. 3 is a sectional side view of the toilet paper case of FIG. 1.

Referring to the drawings, a toilet paper case is shown, including a substantially U-shaped housing 1 which has a base plate segment 13 to be secured to a wall. In two side segments of the housing are respectively provided through-holes 11 and 12.

There is a curved cover plate 2 which is provided with two sleeve members 21 at one end thereof. The cover plate 2 is hinged to the housing 1 by means of a shaft 22 which is inserted in the sleeve members 21 and whose ends are journalled in the through-holes 11 of the housing 1 and are attached with nuts 26. A spring 4 is attached to the shaft 22 so as to bias the cover plate to an open position. Flanges 25 are provided at two sides of the cover plate 2. These flanges 25 abut with the side segments of the housing when the cover plate is closed so that the housing can be sealed off thereat effectively.

The other end of the cover plate 2 is forked and toothed so that the cover plate 2 has an inner toothed edge 231 and an outer toothed edge 232 extending in a position parallel to the axis of the shaft 22. Preferably, the inner toothed edge 231 and the outer toothed edge 232 are provided with sharp teeth. Two tongues 24 are respectively formed on two lugs 241 extending from two sides of the cover plate 2 so as to engage with the through-holes 12 of the housing 1. By means of the interengagement of the tongues 24 and the through-holes 12, the cover plate 2 is kept in a closed position against the action of the spring 4. The cover plate 2 can be closed by depressing the cover plate 2 against the housing 1, and can be opened by slightly pushing inward the tongue 24 to leave the through-hole 12 of the side segments 14 of the housing 1.

A shaft 3 for holding a reel of toilet paper is mounted rotatably on two substantially U-shaped retaining members 15 which are formed respectively on the side segments 14 of the housing 1. The shaft 3 is removable from the retained members 15 so that a used-up reel of the toilet paper may be easily replaced by a new one.

The toilet paper placed in the housing can be cut into pieces as desired by pulling a portion of the toilet paper downward the then pulling it upward to make the paper to abut tightly against the toothed edges 231 and 232 of the cover plate. In this situation, the inner toothed edge 231 engages the paper and stop the unreeling of the paper, and the outer toothed edge 232 effects the cutting operation.

With the invention thus explained, it is apparent that numerous modifications and variations can be made without departing from the scope of the invention. It is therefore intended that the invention be limited only as indicated in the appended claims.

What I claim is:

1. A toilet paper case comprising:

a U-shaped housing having a base mounting segment and two side segments, being opened at a top side, a front side and a bottom side thereof; and a curved cover plate covering said top side and said front side of said housing and having a rear end and a front end, said rear end being hinged to said housing at said top side and extending forward and then downward, said front end being forked so as to have an inner toothed edge and an outer toothed edge, said inner toothed edge engaging the paper so as to stop the unreeling of the paper and said outer toothed edge cutting the paper.

2. A toilet paper case comprising:

a U-shaped housing having a base mounting segment and two side segments, being opened at a top side, a front side and a bottom side thereof;

a curved cover plate covering said top side and said front side of said housing and having a rear end and a front end, said rear end being hinged to said housing at said top side and extending forward and then downward, said front end being forked so as to have an inner toothed edge and an outer toothed edge, said inner toothed edge engaging the paper so as to stop the unreeling of the paper and said outer toothed edge cutting the paper;

an elastic member to bias said cover plate to retain an open position;

a tongue-and-hole engagment means provided on said housing and said cover plate so as to prevent said cover plate from being moved to said open position;

a shaft mounted movably on said housing for carrying a reel of toilet paper.

3. A toilet paper case as claimed in claim 2, wherein said inner toothed edge and said outer toothed edge are provided with sharp teeth.

4. A toilet paper case as claimed in claim 2, in which said tongue-and-hole engagement means includes holes which are provided in said side segments adjacent to said front side of said housing, wherein said cover plate has two lugs extending from two opposite sides of said cover plate and substantially normal to said cover plate, said lugs abutting with said side segments when said cover plate is closed, and said tongue-and-hole engagement means further includes two tongues respectively projecting from said lugs to engage with said holes.

* * * * *